US005792223A

United States Patent [19]

Rivas et al.

[11] Patent Number: 5,792,223

[45] Date of Patent: Aug. 11, 1998

[54] NATURAL SURFACTANT WITH AMINES AND ETHOXYLATED ALCOHOL

[75] Inventors: Hercilio Rivas; Xiomara Gutierrez; Antonio E. Cardenas; Amanda Morles, all of Caracas, Venezuela

[73] Assignee: Intevep, S.A., Caracas, Venezuela

[21] Appl. No.: 822,232

[22] Filed: Mar. 21, 1997

[51] Int. Cl.[6] ..... C10L 1/32

[52] U.S. Cl. ..... 44/302; 44/301

[58] Field of Search ..... 44/302, 301

[56] References Cited

U.S. PATENT DOCUMENTS

| | | | |
|---|---|---|---|
| 4,732,576 | 3/1988 | Friedrich et al. | 44/302 |
| 4,744,796 | 5/1988 | Hazbun et al. | 44/302 |
| 4,976,745 | 12/1990 | Rodriguez et al. | 44/301 |
| 5,411,558 | 5/1995 | Taniguchi et al. | 44/301 |
| 5,419,852 | 5/1995 | Rivas et al. | 44/301 |
| 5,437,693 | 8/1995 | Iizuka et al. | 44/302 |
| 5,480,583 | 1/1996 | Rivas et al. | 44/301 |
| 5,503,772 | 4/1996 | Rivas et al. | 44/301 |
| 5,556,574 | 9/1996 | Rivas et al. | 44/301 |
| 5,603,864 | 2/1997 | Silva et al. | 44/301 |
| 5,622,920 | 4/1997 | Rivas et al. | 44/301 |

OTHER PUBLICATIONS

Kirk-Othmer, Encyclopedia of Chemical Technology, 3rd edition, vol. 8, pp. 900–904, 906, 908–920, (date unknown).

*Primary Examiner*—Jerry D. Johnson
*Attorney, Agent, or Firm*—Bachman & LaPointe, P.C.

[57] ABSTRACT

A stable hydrocarbon-in-water emulsion includes a hydrocarbon phase containing natural surfactant; a water phase having an electrolyte content greater than about 10 ppm (wt) and less than or equal to about 100 ppm (wt) with respect to the water phase; and a surfactant additive including an amine and an ethoxylated alcohol in amounts effective to activate the natural surfactant and stabilize the emulsion.

32 Claims, 11 Drawing Sheets

NATURAL SURFACTANT WITH AMINES AND ETHOXYLATED ALCOHOL

BACKGROUND OF THE INVENTION

The invention relates to an emulsion of a hydrocarbon-in-water, preferably bitumen in water, which is stable and which is suitable for use as a combustible fuel.

Bitumen in water emulsions are one source of fuel in the world energy market. Typically, the emulsion is formed using surfactants which can add significantly to the cost of the emulsion. Further, some surfactant such as ethoxylated alkyl phenol are considered to be environmentally undesirable, and a number of organizations such as the European Economic Community have regulations which may prohibit the use of ethoxylated alkyl phenol in combustible fuels and other applications.

Accordingly, the need remains for a hydrocarbon-in-water emulsion and method for making same wherein the emulsion is formed and stabilized using materials which are economically and environmentally desirable.

It is therefore the primary object of the present invention to provide an emulsion which is formed and stabilized without ethoxylated alkyl phenol.

It is a further object of the present invention to provide an emulsion wherein natural surfactants contained in the hydrocarbon or bitumen phase are activated and used for forming and stabilizing the emulsion.

It is a still further object of the present invention to provide a method for making an emulsion of hydrocarbon-in-water wherein reduced amounts of surfactant additive are needed.

It is another object of the present invention to provide a surfactant additive which is useful in forming emulsions of viscous hydrocarbon or bitumen in water wherein the emulsion is not sensitive to changes in pH or salinity of the aqueous phase.

It is still another object of the present invention to provide a hydrocarbon-in-water emulsion and method for forming same wherein a broader spectrum of dilution water can be used.

It is yet another object of the present invention to provide a method for forming emulsions of viscous hydrocarbon or bitumen in water.

Other objects and advantages will appear hereinbelow.

SUMMARY OF THE INVENTION

In accordance with the invention, the foregoing objects and advantages are readily attained.

According to the invention, a stable hydrocarbon-in-water emulsion is provided comprising: a hydrocarbon phase containing natural surfactant; a water phase having an electrolyte content greater than about 10 ppm (wt) and less than or equal to about 100 ppm (wt) with respect to the water phase; and a surfactant additive comprising an amine and an ethoxylated alcohol in amounts effective to activate said natural surfactant and stabilize the emulsion.

Further according to the invention, a method for forming the emulsion is provided which method comprises the steps of providing a hydrocarbon phase containing natural surfactant; providing a water phase having an electrolyte content greater than about 10 ppm (wt) and less than or equal to about 100 ppm (wt) with respect to the water phase; mixing said hydrocarbon phase and said water phase with a surfactant additive comprising an amine and an ethoxylated alcohol in amounts effective to activate said natural surfactant and stabilize the emulsion.

Still further according to the invention, a surfactant additive is provided which comprises a surfactant additive for preparation of a hydrocarbon-in-water emulsion, comprising an amine and an ethoxylated alcohol in a ratio by weight of amine to ethoxylated alcohol of between about 5:1 to about 1:2.

BRIEF DESCRIPTION OF THE DRAWINGS

A detailed description of preferred embodiments of the invention follows, with reference to the attached drawings wherein.

DETAILED DESCRIPTION

Figure 1:
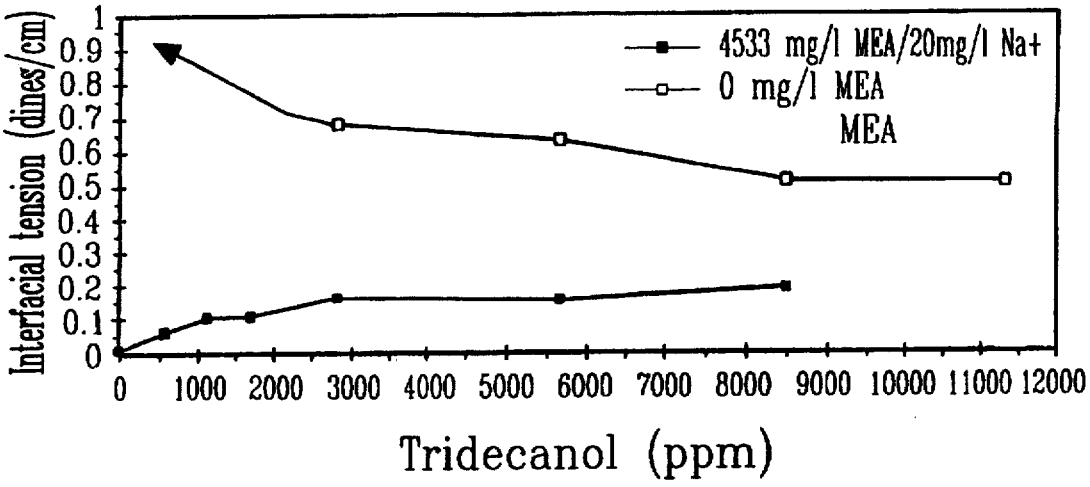
FIG. 1 illustrates interfacial tension in bitumen in water emulsions including only polyethoxylated tridecanol, and emulsions including a mixture of polyethoxylated tridecanol, monoethanolamine and sodium ions.

The invention relates to a stable hydrocarbon-in-water emulsion, to a surfactant additive which is useful for forming the emulsion and to a method for forming emulsions using the surfactant additive to activate natural surfactant contained in the hydrocarbon.

According to the invention, stable hydrocarbon in water emulsions are formed and provided using a surfactant additive which is both environmentally and economically desirable. The preferred emulsions are those formed of a hydrocarbon bitumen, ideally bitumen such as Cerro Negro bitumen which includes natural surfactants. The surfactant additive of the present invention advantageously serves to activate the natural surfactants of the bitumen so as to form the desired hydrocarbon-in-water emulsion and further serves to stabilize the emulsion against factors such as variation in aqueous phase pH and/or salinity.

A typical hydrocarbon phase for use in accordance with the present invention is a Cerro Negro bitumen, typically having a composition as set forth in Table 1:

TABLE 1

| COMPONENTS | |
|---|---|
| API Gravity | 8.1 |
| Saturated (%) | 29.4 |
| Aromatics (%) | 35.6 |
| Resin (%) | 18.9 |
| Asphaltene | 16.1 |
| Acid (mg KOH/g) | 3.02 |
| Carbon (%) | 80.3 |
| Hydrogen (%) | 9.9 |
| Nitrogen (ppm) | 6188 |
| Sulphur (%) | 3.7 |
| Vanadium (ppm) | 367.4 |
| Nickel (ppm) | 95.5 |
| Sodium (ppm) | 11.8 |
| Conradson Carbon (%) | 17.2 |
| Water Content (%) | 0.1 |

Bitumen such as that described in Table 1 above is used in preparation of a hydrocarbon in water emulsion which is sold by Bitor, S. A. under the trademark Orimulsion, and this emulsion is suitable for combustion as a liquid fuel and other end uses such as transportation to a refinery for further processing and the like. According to the present invention, a similar emulsion is provided using a surfactant additive which provides the emulsion with desirable rheological properties and stability, and which additive is both economically and environmentally desirable.

Furthermore, although conventionally formed emulsions have been found to be sensitive to electrolyte content in the emulsion water of greater than about 10 ppm, emulsions formed using the surfactant additive of the present invention can be prepared using water having an electrolyte content up to about 100 ppm. This advantageously allows for use of a greater spectrum of water for preparing the emulsion of the present invention.

Most naturally occurring viscous hydrocarbon material, including Cerro Negro bitumen as described above, contains inactive surfactant including carboxylic acids, phenols and esters which, under proper conditions, can be activated as surfactants. According to the present invention, a surfactant additive is provided which activates these natural surfactants, and which further serves to stabilize an emulsion formed using the natural surfactants so as to reduce the sensitivity of the emulsion to variation in pH and water salinity. Further, the surfactant additive of the present invention can be used to replace environmentally undesirable surfactant additives such as ethoxylated alkyl phenol.

According to the invention, a surfactant additive is provided which comprises an amine and an ethoxylated alcohol. In accordance with the invention, the amine has been found to activate the natural surfactants from bitumen, and the ethoxylated alcohol portion serves to stabilize the emulsion and reduce the sensitivity of the emulsion to variations in pH and changes in salinity in the aqueous phase of the emulsion. Furthermore, and as will be set forth below, the surfactant additive of the present invention can be used to provide stable emulsions using amounts of the amine and alcohol portions sufficiently small that the surfactant additive is desirable from an economic standpoint as well.

In accordance with the invention, the amine is preferably selected from the group consisting of monoethanolamine, ethylenediamine, ethylamine, diethylamine, triethylamine, propylamine, sec-propylamine, dipropylamine, isopropylamine, butylamine, sec-butylamine, tetramethylammonium hydroxide, tetrapropylammonium hydroxide and mixtures thereof. Preferably, the amine is an ethanolamine, most preferably monoethanolamine.

The ethoxylated alcohol component of the surfactant additive of the present invention is preferably selected from the group consisting of polyethoxylated C12–C14, saturated polyethoxylated C16–C18, unsaturated polyethoxylated C16–C18 and mixtures thereof, most preferably polyethoxylated tridecanol (C13).

One particularly well suited ethoxylated alcohol for use in accordance with the present invention is a polyethoxylated tridecanol provided by Hoechst de Venezuela under the trademark Genapol X-159 which has physical properties as follows: hydrophilic and lipophilic balance of 15.4; average number of moles, ethylene oxide, of 15; cloud point of 83°; 90% active.

According to the invention, the emulsion is preferably provided having surfactant additive including amine in an amount of at least about 300 parts per million (ppm) (wt) and having ethoxylated alcohol in an amount of at least about 100 ppm (wt) with respect to the hydrocarbon phase. More preferably, amine has been found to be particularly effective at between about 500 ppm to about 1500 ppm, and most preferably at about 800 ppm. Ethoxylated alcohol is preferably present between about 100 ppm to about 3000 ppm, and more preferably between about 500 ppm to about 1500 ppm, also based upon the weight with respect to the hydrocarbon phase.

As set forth above, water can be used for the water phase of the emulsion having an electrolyte content greater than about 10 ppm, and up to about 100 ppm (wt) with respect to the water phase, thereby advantageously providing a greater pool of suitable water for use in making the emulsion. The surfactant additive of the present invention serves to maintain the stability of the emulsion despite the presence of the higher electrolyte content.

Emulsions in accordance with the present invention are preferably provided having a ratio of hydrocarbon or bitumen phase to the water phase of between about 90:10 to about 70:30. As will be discussed below in connection with the process for preparation of the emulsion, it is preferred to prepare an intermediate emulsion having a ratio of approximately 85:15, and to subsequently dilute the emulsion to a ratio of approximately 70:30. These ratios are based upon the volume of hydrocarbon and water.

The final emulsion of the present invention preferably has an average droplet size of less than or equal to about 30 microns, and a viscosity at 30° C. and 1 $sec^{-1}$ of less than or equal to about 1500 cp.

The emulsion of the present invention is formed by mixing the bitumen with an aqueous or water phase and the surfactant additive with sufficient mixing energy to emulsify the mixture and provide an emulsion of the bitumen discontinuous phase in the aqueous continuous phase and having desired droplet size and viscosity.

In accordance with one embodiment of the invention, it has been found that stability of the resulting emulsion is enhanced by forming the emulsion in a two stage process wherein the first step comprises mixing the hydrocarbon or bitumen phase with a portion of the water phase having an electrolyte content less than or equal to about 10 ppm and the surfactant additive so as to form an intermediate emulsion. In a second or subsequent stage, the intermediate emulsion is diluted with the remainder of the desired aqueous or water phase which can have a higher electrolyte content, up to about 100 ppm, so as to provide the desired final stable hydrocarbon-in-water emulsion in accordance with the present invention.

In the two stage process, the intermediate emulsion formation stage may be carried out so as to provide the desired intermediate emulsion with a ratio of bitumen to water by volume of about 90:10, more preferably about 85:15, and the dilution stage preferably includes diluting the intermediate emulsion to a final ratio of hydrocarbon to water by volume of about 70:30.

In accordance with the invention, the surfactant additive per se in accordance with the present invention includes an amine and an ethoxylated alcohol, preferably in a ratio of the amine portion to the ethoxylated alcohol portion of between about 5:1 to about 1:2, more preferably between about 2:1 to about 1:2.

As set forth above, the process of the present invention produces an emulsion having enhanced stability and reduced sensitivity to variations in pH and salinity as well as higher electrolyte content in the emulsion water.

The mixing step or steps of the present invention are preferably carried out so as to supply sufficient energy to the mixture to yield an emulsion having the desired physical characteristics of the end product, especially droplet size and viscosity. In general, smaller droplet sizes require more mixing energy, larger concentration of surfactant additive, or both. According to the invention, the emulsion is preferably mixed with sufficient mixing energy to yield an average droplet size of 30 μm or less. Such an emulsion will have a viscosity of below about 1500 cp at 30° C. and 1 $sec^{-1}$. For example, a conventional mixer may be used so as to mix the emulsion at a rate of at least about 500 rpm.

In accordance with the invention, the surfactant additive of amine and ethoxylated alcohol is suitable in accordance with the invention for forming stable emulsions with desired rheological properties using amounts of amine and ethoxylated alcohol each of which are significantly less than the amount required to form an emulsion with either portion of the additive alone. Furthermore, the sensitivity of the emulsion to variations in pH, divalent salt concentration and/or electrolyte content, typically a problem with emulsions formed by activating natural surfactant from the bitumen, is decreased in the emulsion formed in accordance with the present invention.

The following examples further illustrate the advantageous features and characteristics of the emulsion, process for forming an emulsion and surfactant additive in accordance with the present invention.

EXAMPLE 1

This example illustrates the improved interfacial tension exhibited by a system with an interphase utilizing monoethanolamine (MEA) and ethoxylated tridecanol according to the invention(bitumen/$H_2O$ MEA/Na/ethoxylated tridecanol) as compared to a system with an interphase using only ethoxylated tridecanol (bitumen/$H_2O$ ethoxylated tridecanol).

The interphase (bitumen/$H_2O$ MEA/Na/ethoxylated tridecanol) was made using 4533 mg/l MEA, with 20 mg/l $Na^+$ in the formation water, and with increasing amounts of polyethoxylated tridecanol, and was tested for interfacial tension using a rotary droplet interfacial tensiometer designed by the University of Texas and designated UTSDT-500. Interphase (bitumen/$H_2O$ ethoxylated tridecanol) was also tested with increasing amounts of ethoxylated tridecanol. Referring to FIG. 1, the interfacial tension is presented for the system made using only ethoxylated tridecanol, and for the system made using the surfactant additive according to the present invention including ethoxylated tridecanol and monoethanolamine. As shown, the surfactant additive according to the invention advantageously provided an interfacial tension substantially lower than that provided by ethoxylated tridecanol alone. FIG. 1 also shows that above certain levels, the interfacial tension for both systems becomes substantially stable regardless of increasing amounts of ethoxylated tridecanol.

Figure 2:
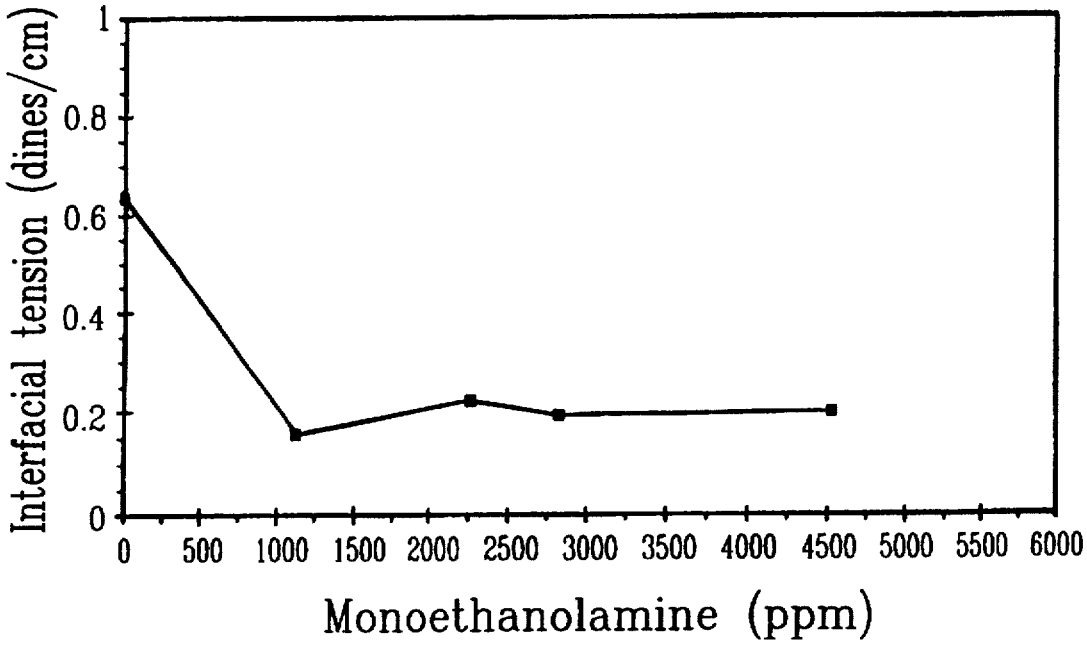
FIG. 2 illustrates the interfacial tension for bitumen in water emulsions having different concentrations of monoethanolamine and 5667 ppm of polyethoxylated tridecanol.

FIG. 2 shows the interfacial tension for systems prepared as described above having varying amounts of monoethanolamine and sodium hydroxide ($Na^+$) in the formation water, and 5667 ppm of polyethoxylated tridecanol in the dilution water. For the system represented by FIG. 2, sodium ions were present at a concentration of 281 parts per million based on the aqueous phase. The concentrations of monoethanolamine and polyethoxylated tridecanol are provided in terms of parts per million by weight with respect to the water in the 85:15 emulsion.

The measurements of interfacial tension were taken at 60° C. As shown, for values of monoethanolamine of approximately 1000 ppm and higher, the interfacial tension is substantially constant at approximately 0.2 dines/cm.

EXAMPLE 2

A number of emulsions were prepared using a Rushton blade coupled to a Heidol pH motor. The emulsions were formed using reconstituted Cerro Negro bitumen as described above in Table 1. Emulsions were prepared having an initial ratio of bitumen:water of 85:15, at a formation temperature of 60° C., under mixing at 200 rpm for two minutes followed by 1500 rpm for one minute. After the respective emulsions were formed, the 85:15 emulsions were diluted to a final emulsion having a ratio of bitumen:water of 70:30. In a first group of emulsions, emulsions were prepared by adding polyethoxylated tridecanol in the formation water at concentrations of 500, 1000 and 1500 ppm, in combination with 800 ppm of monoethanolamine. These concentrations are provided in terms of ppm by weight with respect to the bitumen phase.

A second group of emulsions were prepared by adding monoethanolamine in the formation water along with a source of sodium hydroxide, and subsequently adding ethoxylated tridecanol in the dilution portion of the water. Emulsions were prepared having 0, 150, 250, 350, 550, 1000 and 1500 ppm of polyethoxylated tridecanol for each of 600 and 800 ppm of monoethanolamine, and were also prepared at 1000 ppm of ethoxylated tridecanol with 300, 400 and 500 ppm of monoethanolamine. In each case, sodium hydroxide was added in the formation water at a concentration of 20 ppm of sodium ions with respect to the final emulsion.

Figure 3:
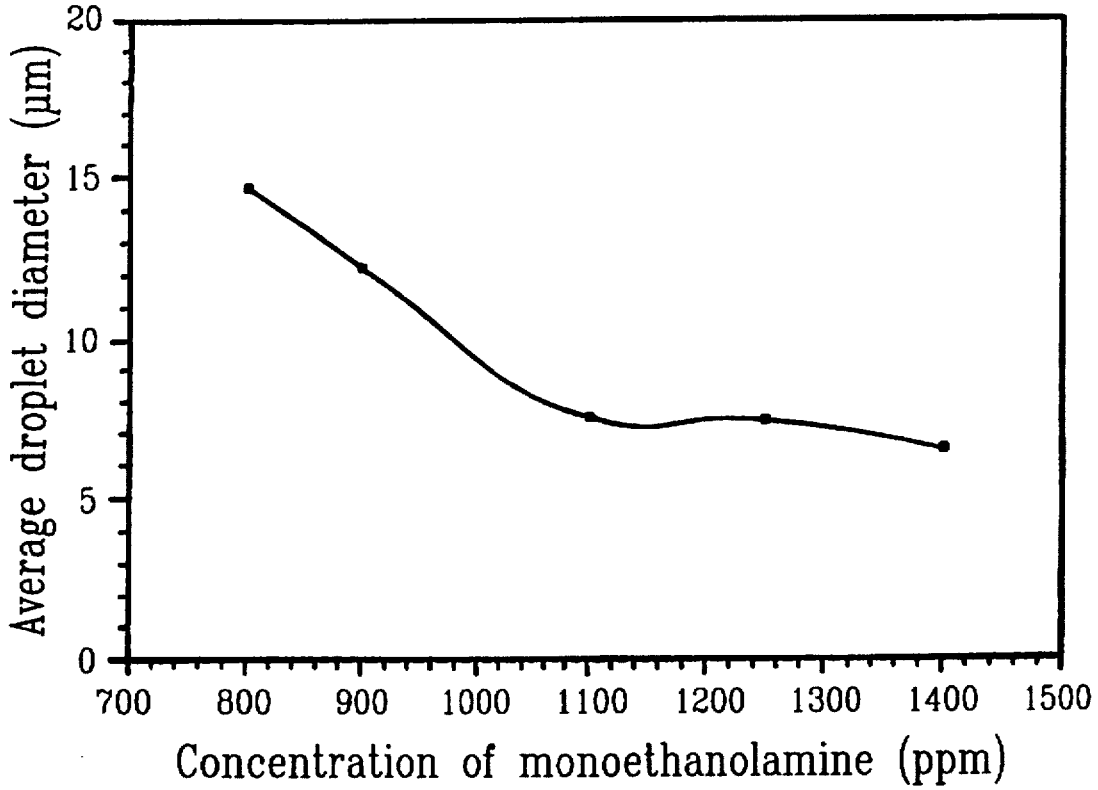
FIG. 3 illustrates the average droplet diameter of emulsions having different concentration of monoethanolamine and 20 ppm sodium ions for emulsions having a ratio of bitumen to water of 85:15.

Average droplet diameter and droplet diameter distributions were determined for the emulsions prepared as above. FIG. 3 shows droplet size for an 85:15 emulsion formed using only monethanolamine with 20 ppm sodium ions in the formation water. It is shown that at concentrations of monoethanolamine of 800 ppm or higher an emulsion having average droplet diameter of less than about 15 μm is formed. However, upon dilution of these emulsions with fresh water to the end desired ratio of bitumen:water of 70:30, the average droplet diameter of these emulsions increased undesirably. Without being bound by any particular theory, it is believed that the additional fresh water causes a decrease in pH of the aqueous phase, and further that the fresh water containing a certain amount of Ca+2 electrolyte results in a decrease in the activity of the natural surfactant of the bitumen.

Figure 4:
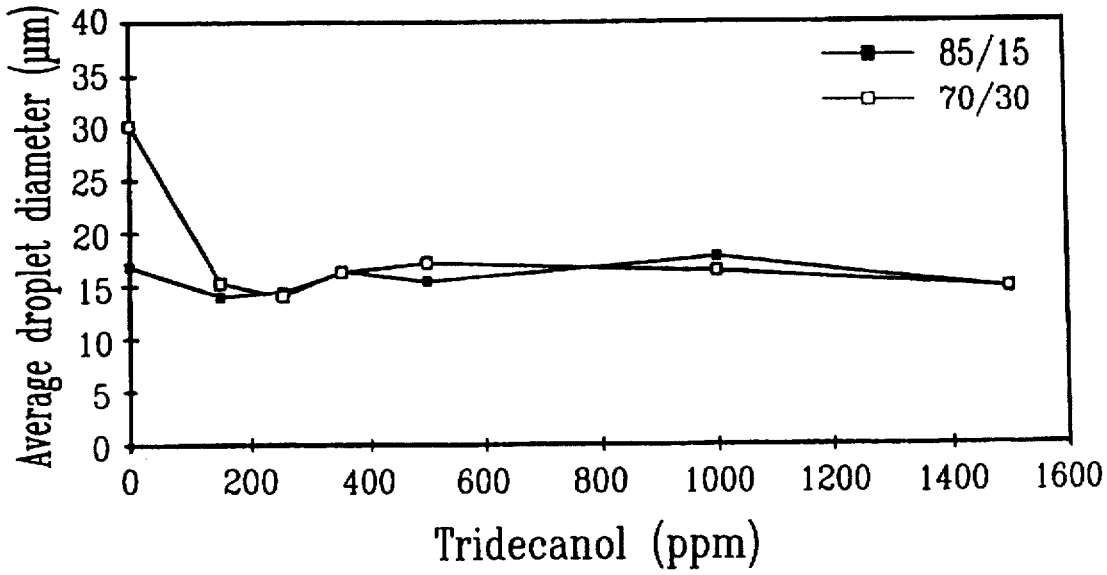
FIG. 4 illustrates the average droplet diameter of emulsions having different concentrations of ethoxylated tridecanol at ratios of bitumen to water of 85:15 and 70:30, with monoethanolamine and sodium added during emulsion formation and ethoxylated tridecanol added during dilution.

FIG. 4 shows the average droplet diameter for the intermediate emulsions prepared as above having a ratio of 85:15 and a final emulsion having a ratio of 70:30, for emulsions formed using 800 ppm monoethanolamine and 20 ppm sodium ions in the formation water and varying amounts of ethoxylated tridecanol in the dilution water. As shown, the final 70:30 emulsion provided desirable average droplet diameters of approximately 15 μm at a level of ethoxylated tridecanol of 200 ppm and higher. Note the value of average droplet diameter for the 70:30 emulsion with 0 ppm ethoxylated tridecanol is approximately 30 μm.

Figure 5:
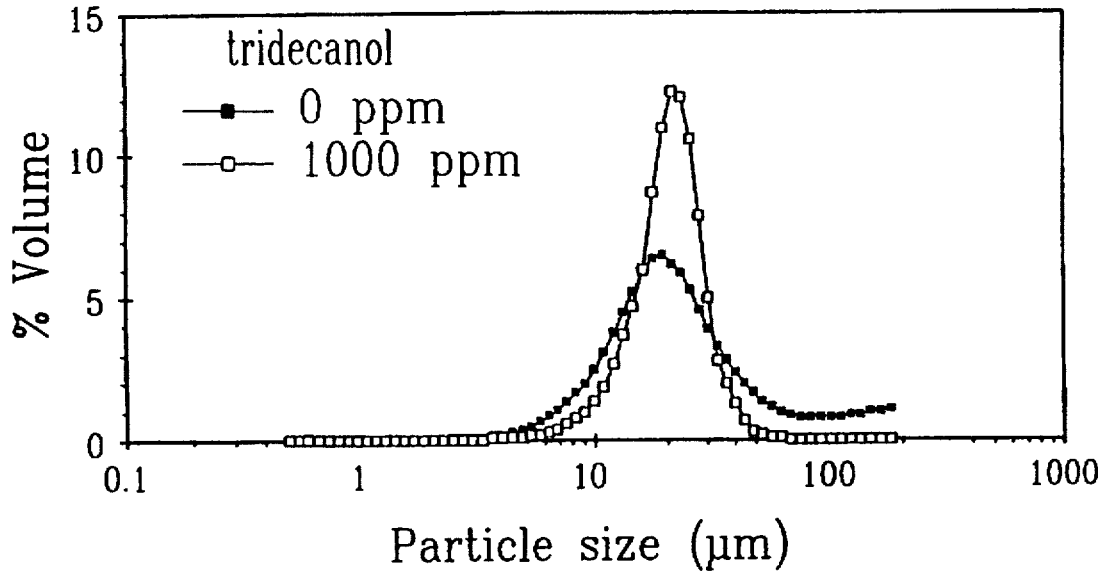
FIG. 5 illustrates the droplet diameter distribution for emulsions, one having only monoethanolamine and sodium and the other having monoethanolamine, sodium and ethoxylated tridecanol.

FIG. 5 shows the droplet size distribution for final emulsions having a ratio by volume of bitumen:water of 70:30 for two emulsions, one prepared with 800 ppm monoethanolamine and 20 ppm sodium ions in the formation water and 1000 ppm ethoxylated tridecanol in the dilution water, and the other prepared with 800 ppm ethanolamine and 20 ppm sodium ions in the formation water and 0 ppm ethoxylated tridecanol in the dilution water. As shown, the emulsion formed in accordance with the present invention and utilizing the surfactant additive of the present invention has a far narrower and more desirable droplet size distribution.

EXAMPLE 3

Figure 6:
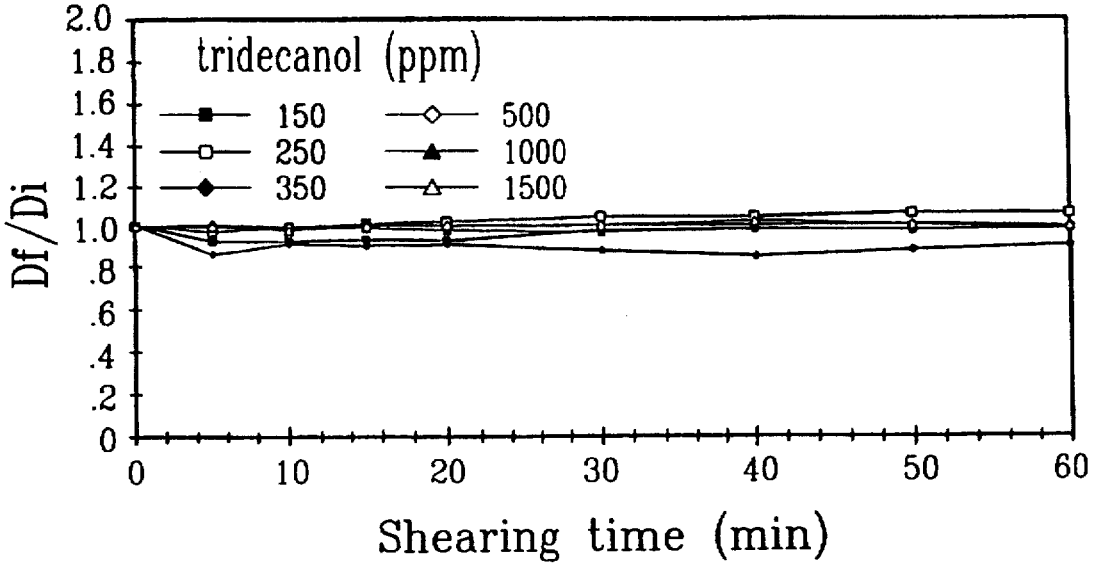
FIG. 6 shows the relation of the ratio Df/Di to shearing time for emulsions having 800 ppm monoethanolamine, 20 ppm sodium and varying amounts of ethoxylated tridecanol.

This example demonstrates the dynamic stability of emulsions formed in accordance with the present invention. A number of emulsions were prepared in accordance with the present invention and sheared at a velocity of 5000 rpm for 60 minutes at a temperature of 30° C. During this time, samples were taken every 5 minutes during the first 20 minutes, and every 10 minutes thereafter, and the samples were tested to determine distribution and average droplet diameter as well as viscosity before and after the shearing. Measurements of viscosity were taken using a viscosimeter Model Haake RV 20 with concentric cylinders of type MV-1. Average droplet diameter distribution was determined using a particle analyzer (Mastersizer/E Malvern) and shear was applied using a mixer (T. K. Mixing Analyzer MA-2500) with a high viscosity blade. Referring to FIG. 6, results of the dynamic stability test are illustrated using a final emulsion of 70:30 ratio which was prepared using 800 ppm of monoethanolamine and 20 ppm of sodium ions in the formation water and which was diluted with fresh water containing ethoxylated tridecanol at concentrations between 150 and 1500 ppm. The results of these measurements are also set forth below in Table 2.

TABLE 2

| Shearing Time | Average Droplet Diameter (μ) Ethoxylated Tridecanol Concentration ppm | | | | | |
|---|---|---|---|---|---|---|
| (min) | 150 | 250 | 350 | 500 | 1000 | 1500 |
| 0 | 15.24 | 14.14 | 16.31 | 20.16 | 13.05 | 13.88 |
| 5 | 14.05 | 13.69 | 14 | 20.3 | 12.97 | 13.83 |
| 10 | 14.12 | 14.09 | 14.85 | 20.22 | 12.86 | 13.61 |
| 15 | 14.21 | 14.38 | 14.7 | 20.45 | 12.96 | 13.85 |
| 20 | 14.18 | 14.48 | 14.83 | 20.26 | 12.8 | 13.97 |
| 30 | 14.98 | 14.86 | 14.37 | 20.4 | 12.62 | 14.01 |
| 40 | 15 | 14.87 | 13.93 | 20.42 | 12.86 | 14.23 |
| 50 | 14.92 | 15.06 | 14.38 | 20.34 | 12.74 | 13.99 |
| 60 | 14.96 | 15.06 | 14.75 | 20.13 | 12.97 | 13.94 |
| Visc. Initial (mPas) | 529 | 638 | 723 | 1013 | 1000 | 865 |
| Visc. Final | 671 | 658 | 543 | 935 | 978 | 825 |

Referring to FIG. 6, it is readily apparent that the ratio of final droplet diameter to initial droplet diameter, Df/Di, remains substantially constant during the mixing time as desired, thereby indicating a stable emulsion.

Figure 7:
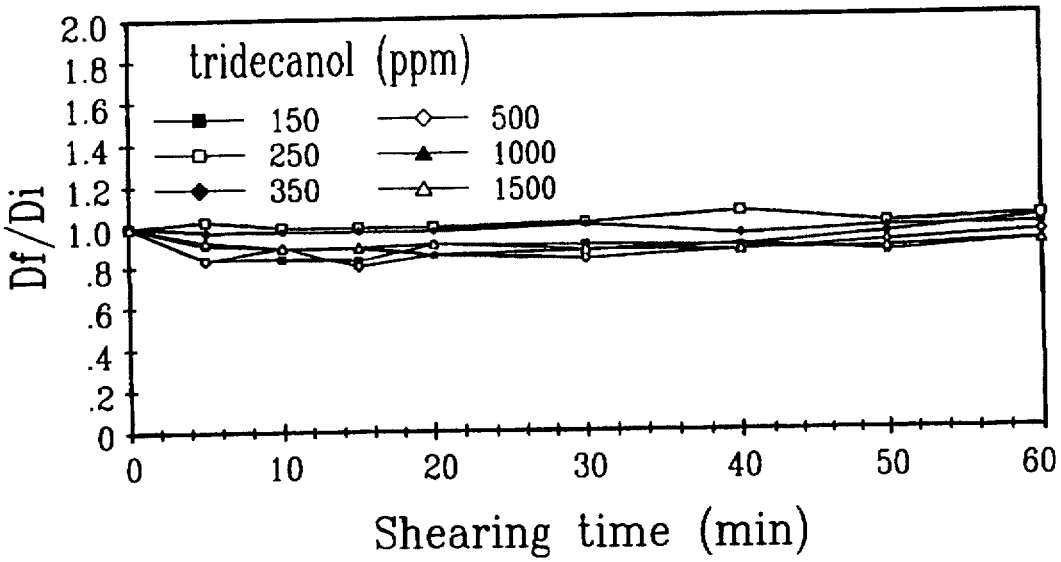
FIG. 7 shows the relationship of the ratio Df/Di to shearing time for emulsions having 600 ppm monoethanolamine, 20 ppm sodium and varying amounts of ethoxylated tridecanol.

Referring to FIG. 7, similar results were obtained for an emulsion formed according to the same procedure, but having a content of monoethanolamine of 600 ppm. Table 3 set forth below also contains this data.

TABLE 3

| Shearing Time | Average Droplet Diameter (μ) Ethoxylated Tridecanol Concentration ppm | | | | | |
|---|---|---|---|---|---|---|
| (min) | 150 | 250 | 350 | 500 | 1000 | 1500 |
| 0 | 16.14 | 14.94 | 17.05 | 22.91 | 23.27 | 24.37 |
| 5 | 13.5 | 15.36 | 16.77 | 19 | 21.25 | 22.67 |
| 10 | 13.62 | 15 | 16.73 | 20.6 | 20.74 | 21.8 |
| 15 | 13.36 | 14.98 | 16.64 | 18.34 | 20.74 | 21.92 |
| 20 | 14.63 | 14.88 | 16.64 | 19.63 | 20.02 | 22.31 |
| 30 | 14.64 | 15.23 | 17.2 | 19.15 | 20.44 | 21.53 |
| 40 | 14.6 | 16.05 | 16.42 | 20.07 | 21.12 | 21.38 |
| 50 | 15.47 | 15.08 | 16.85 | 20.95 | 20.05 | 21.59 |
| 60 | 16.46 | 15.33 | 16.83 | 21.76 | 21.11 | 22.09 |
| Visc. Initial (mPas) | 687 | 689 | 693 | 791 | 764 | 603 |
| Visc. Final (mPas) | 618 | 713 | 721 | 708 | 653 | 660 |

As shown in FIG. 7, the Df/Di ratio is still substantially constant when 600 ppm ethanolamine are used. Also, referring to Tables 2 and 3, final viscosity numbers are acceptably close to the initial viscosity prior to application of shear.

Figure 8:
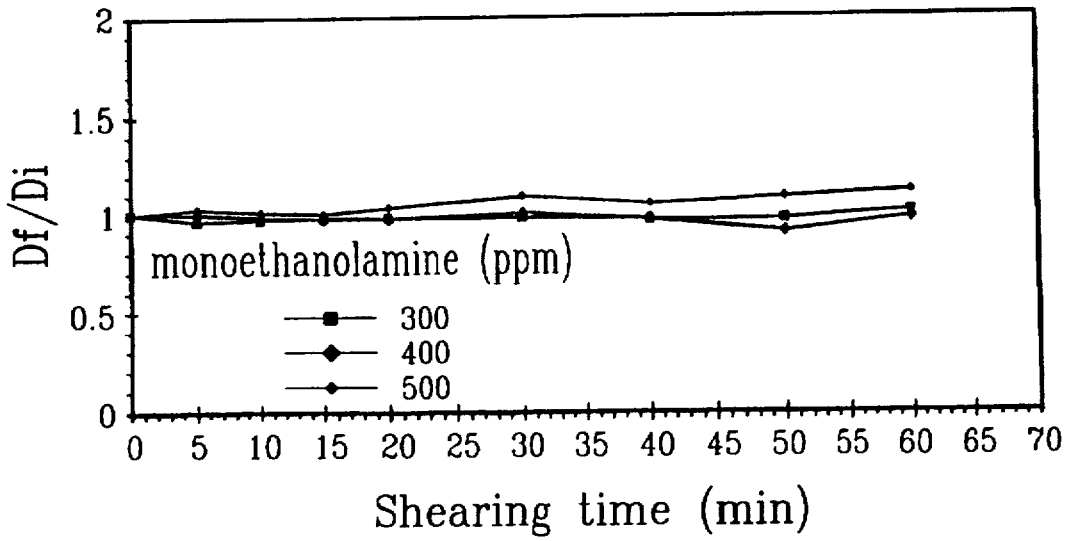
FIG. 8 shows the relation of the ratio Df/Di to shearing time for emulsions having 1000 ppm ethoxylated tridecanol and varying amounts of monoethanolamine with 20 ppm sodium ions.

FIG. 8 and Table 4 set forth below show further data for emulsions prepared and tested as above using concentrations of ethoxylated tridecanol of 1000 ppm in dilution, and 20 ppm $Na^+$ in the formation water with monoethanolamine in concentration of 300, 400 and 500 ppm.

TABLE 4

| Shearing Time | Average Droplet Diameter (μm) Concentration of monoethanolamine | | |
|---|---|---|---|
| (min) | 300 | 400 | 500 |
| 0 | 18.39 | 18.02 | 14.51 |
| 5 | 17.79 | 18.06 | 14.93 |
| 10 | 17.9 | 17.74 | 14.71 |
| 15 | 18.09 | 17.64 | 14.56 |
| 20 | 18.12 | 17.73 | 15.1 |
| 30 | 18.26 | 18.28 | 16.09 |
| 40 | 18.14 | 17.85 | 15.58 |
| 50 | 18.07 | 16.59 | 16.05 |
| 60 | 18.78 | 17.7 | 16.4 |
| Visc. Initial (mPas) | 925 | 978 | 1023 |
| Visc. Final (mPas) | 915 | 762 | 859 |

Referring to FIG. 8, it is clear that the ratio Df/Di remains substantially constant for the various tested levels of monoethanolamine. Further, Table 4 shows that initial and final viscosity numbers are also acceptably close to the initial viscosity levels.

The emulsions tested in connection with FIGS. 6–8 clearly show that bitumen-in-water emulsions formed using the surfactant additive of the present invention and in accordance with the process of the present invention result in emulsions which have a high dynamic stability over large variations of concentration of both monoethanolamine and ethoxylated tridecanol. This is advantageous in that a great degree of operational flexibility is provided so as to allow selection of levels of monoethanolamine and/or ethoxylated tridecanol suitable for other desired characteristics of the emulsion.

EXAMPLE 4

This example illustrates static stability of emulsions prepared in accordance with the present invention. Emulsions were prepared having various contents of monoethanolamine, sodium ions and polyethoxylated tridecanol in accordance with the process of the present invention, and stored in close-shut glass container in thermostatic baths at 25° C. and 45° C. At regular time intervals, samples were taken from the containers and analyzed to determine droplet size distributions, average droplet diameter and viscosity using equipment as discussed above.

Figure 9:
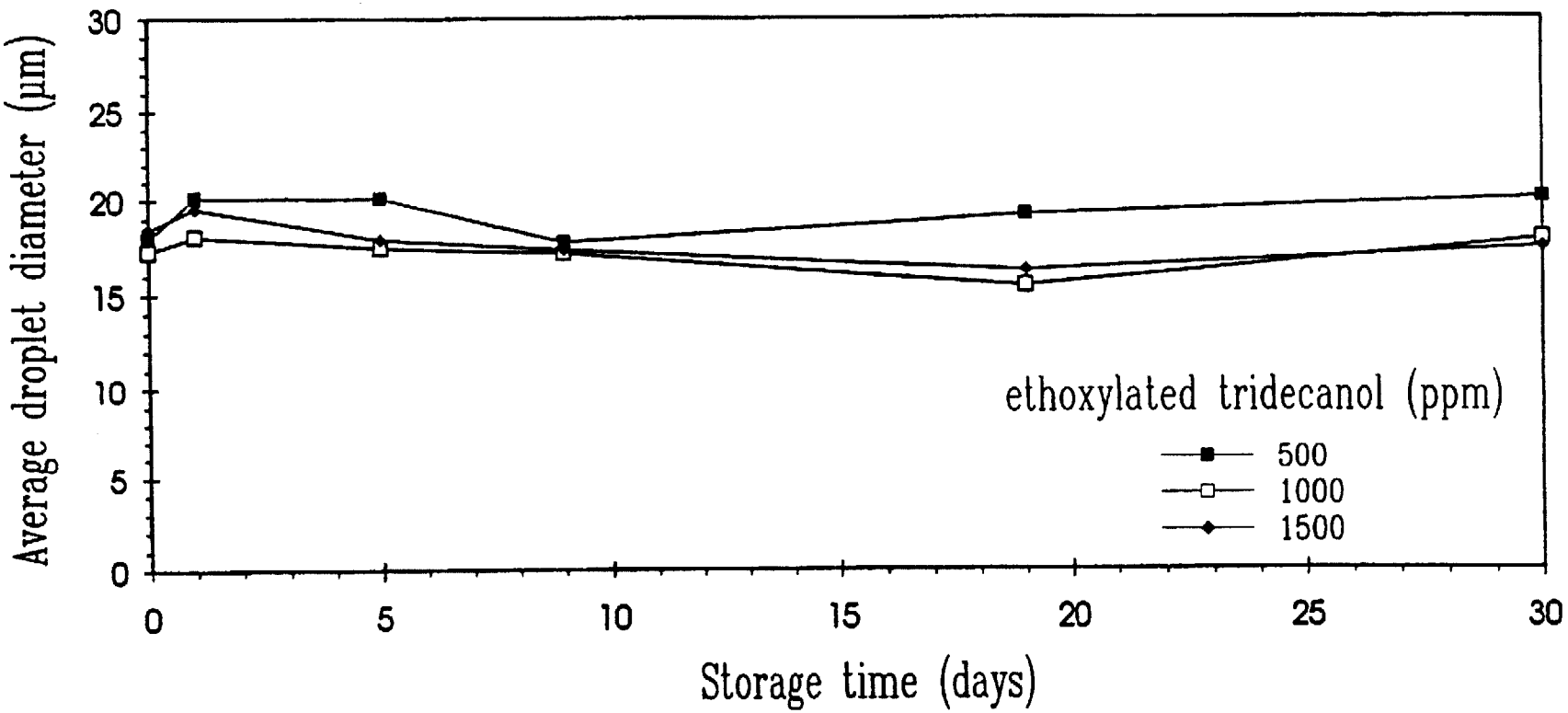
FIG. 9 shows average droplet size related to storage time for emulsions having 800 ppm monoethanolamine, 20 ppm sodium ions and varying amounts of ethoxylated tridecanol, wherein the emulsion is stored at 25° C.
Figure 10:
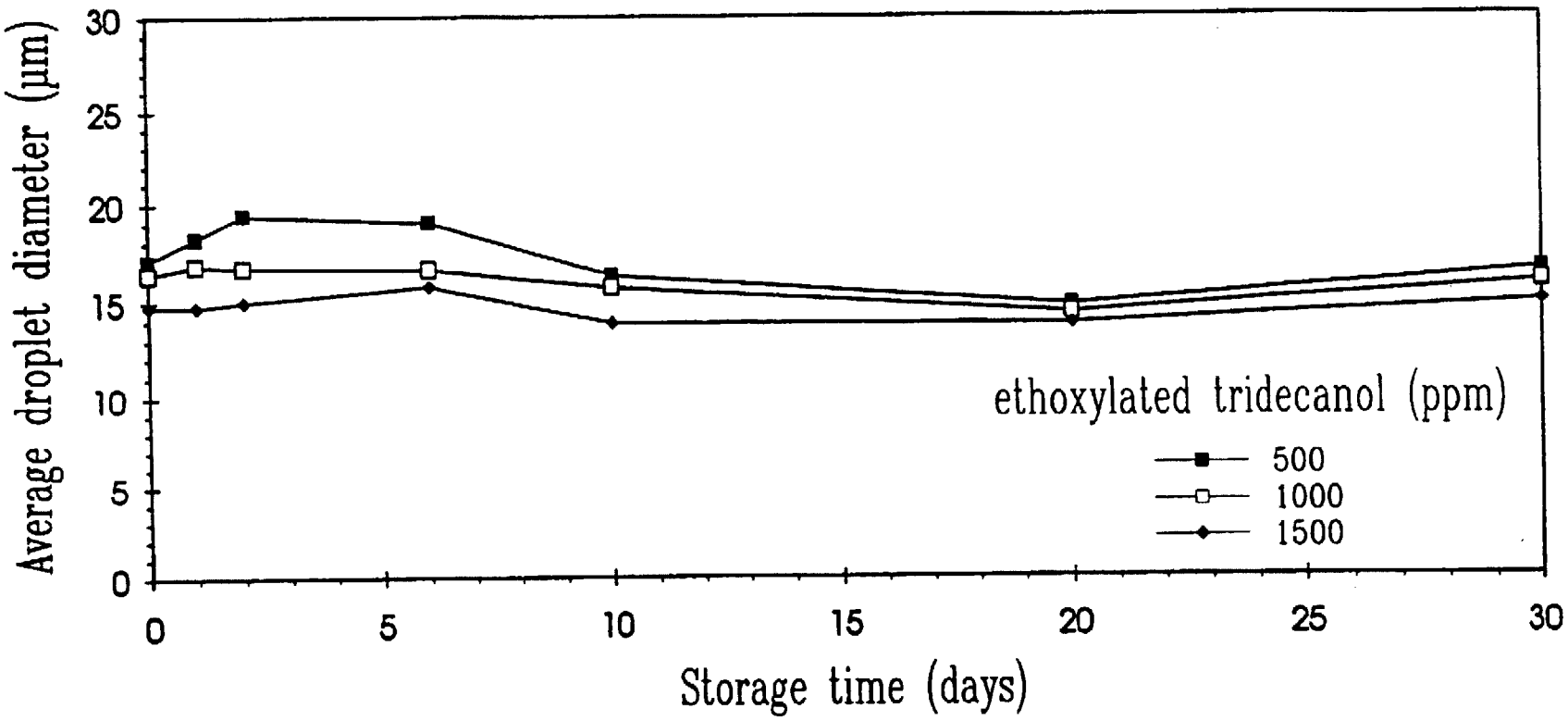
FIG. 10 shows the relation between average droplet diameter and storage time for emulsions having 800 ppm monoethanolamine, 20 ppm sodium ions and varying amounts of ethoxylated tridecanol, wherein the emulsions are stored at 45° C.

FIGS. 9 and 10 respectively show average droplet diameter as a function of storage time for emulsions formed having 800 ppm monoethanolamine, 20 ppm of sodium from sodium hydroxide and 500, 1000 and 1500 ppm of ethoxylated tridecanol, respectively stored at 25° C. and 45° C. FIGS. 9 and 10 show a slight increase in average droplet diameter in the first day, followed by a substantially stable average droplet diameter over the remainder of the storage period.

Figure 11:
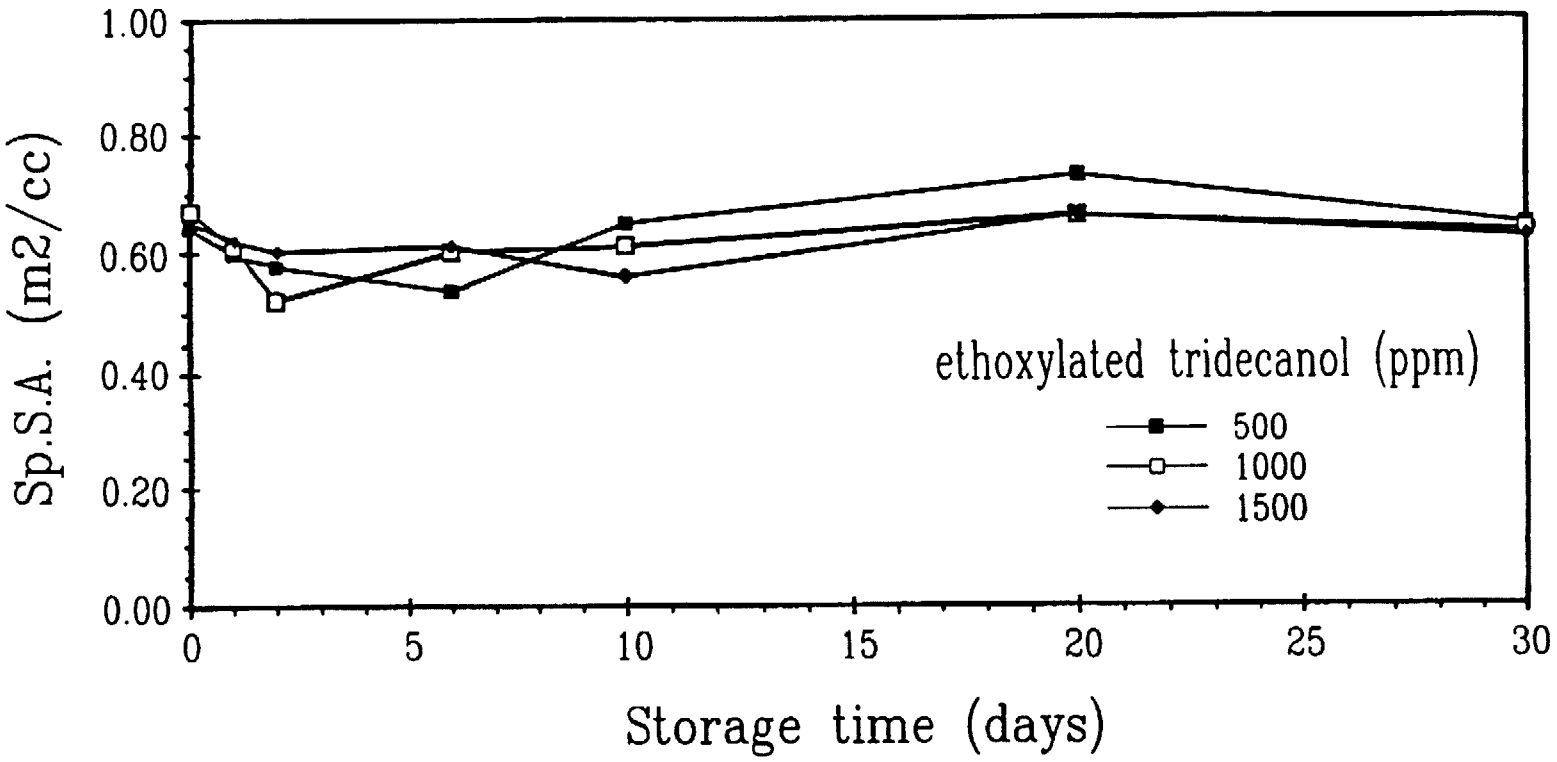
FIG. 11 shows the relations of specific surface area related to storage time for emulsions having 800 ppm monoethanolamine, 20 ppm sodium ions and different concentrations of ethoxylated tridecanol, wherein the emulsion is stored at 45° C.
Figure 12:
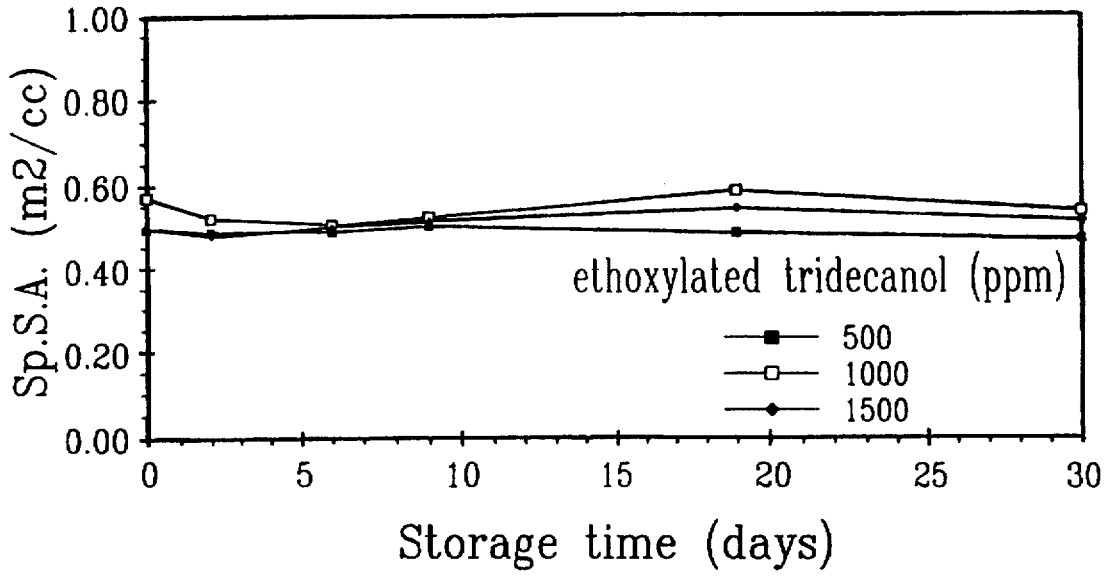
FIG. 12 shows the relationship between specific surface area to storage time for emulsions having 800 ppm monoethanolamine, 20 ppm sodium ions and different concentrations of ethoxylated tridecanol, wherein the emulsions are stored at 25° C.

Specific surface area of the emulsions was also measured, and the results are illustrated in FIG. 11 for storage at 45° C. and FIG. 12 for storage at 25° C. As shown in these figures, emulsions prepared in accordance with the present invention have a substantially constant specific surface area over the entire storage time, thereby indicating little or no coalescence and, thereby, excellent emulsion stability.

Figure 13:
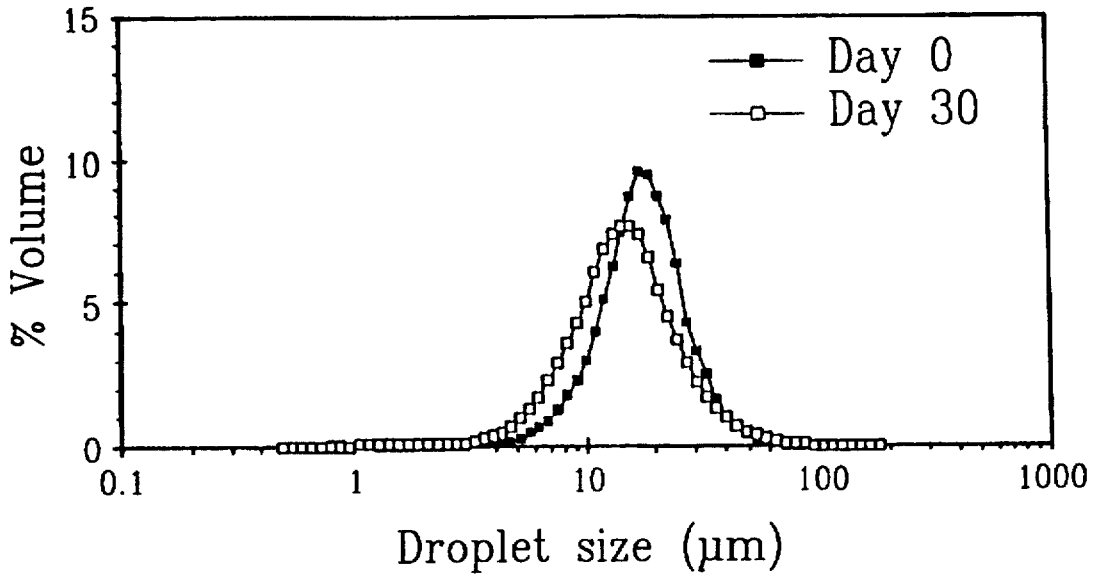
FIG. 13 shows the droplet size distribution for an emulsion having 800 ppm monoethanolamine, 20 ppm sodium ions and 1000 ppm ethoxylated tridecanol at day 0 and at day 30 after storage at 25° C.
Figure 14:
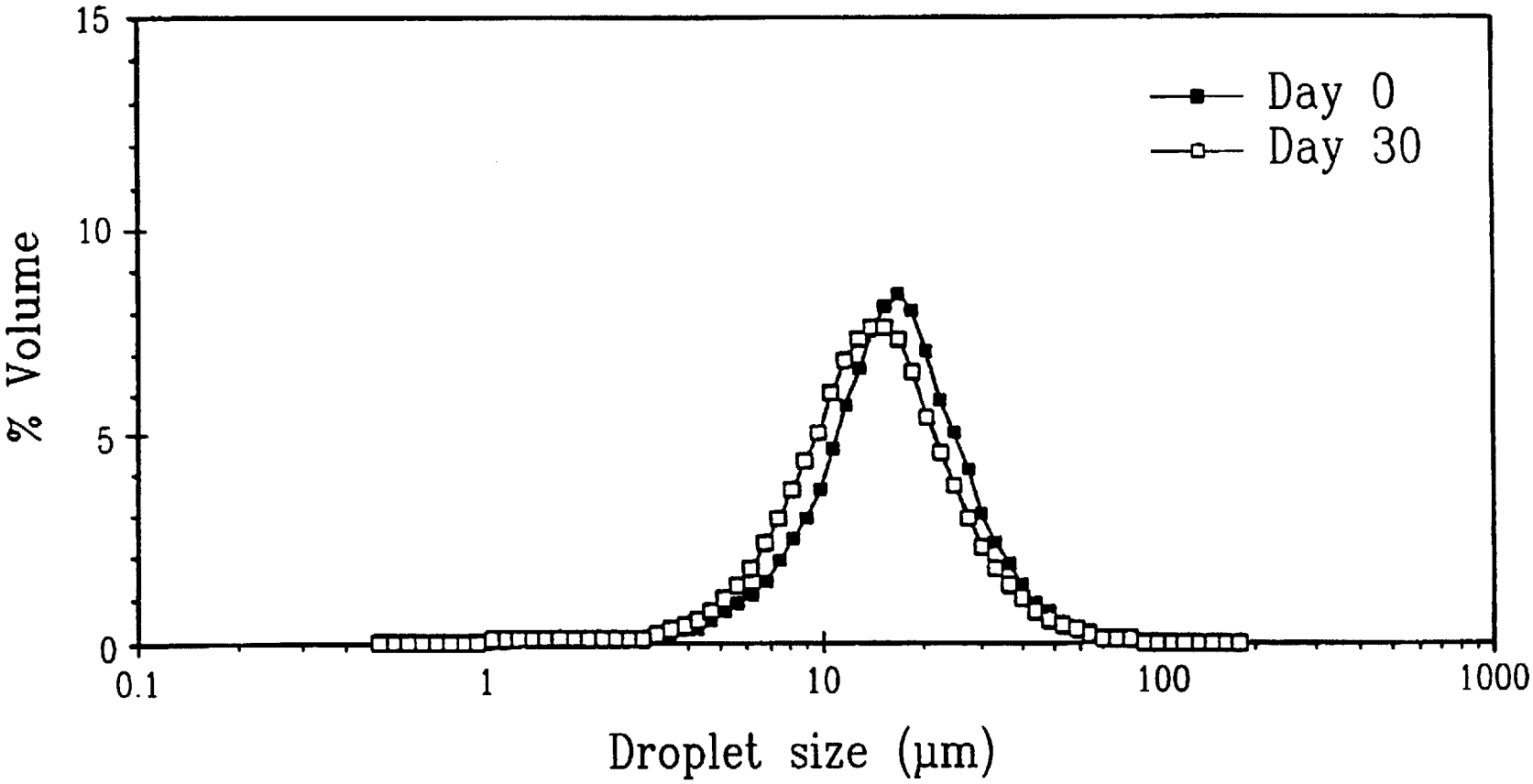
FIG. 14 illustrates the droplet diameter distribution for an emulsion having 800 ppm monoethanolamine, 20 ppm sodium ions and 1000 ppm ethoxylated tridecanol at day 0 and at day 30 after storage at 45° C.

FIGS. 13 and 14 show the droplet distribution for emulsions formed using 800 ppm monoethanolamine and 20 ppm sodium ions in the formation water and 1000 ppm ethoxylated tridecanol in the dilution water wherein the emulsion is stored at 25° C. and 45° C. respectively. As shown, the day 30 distribution is not substantially changed from the day 0 distribution, thereby further indicating that emulsions formed in accordance with the present invention have excellent stability.

Figure 15:
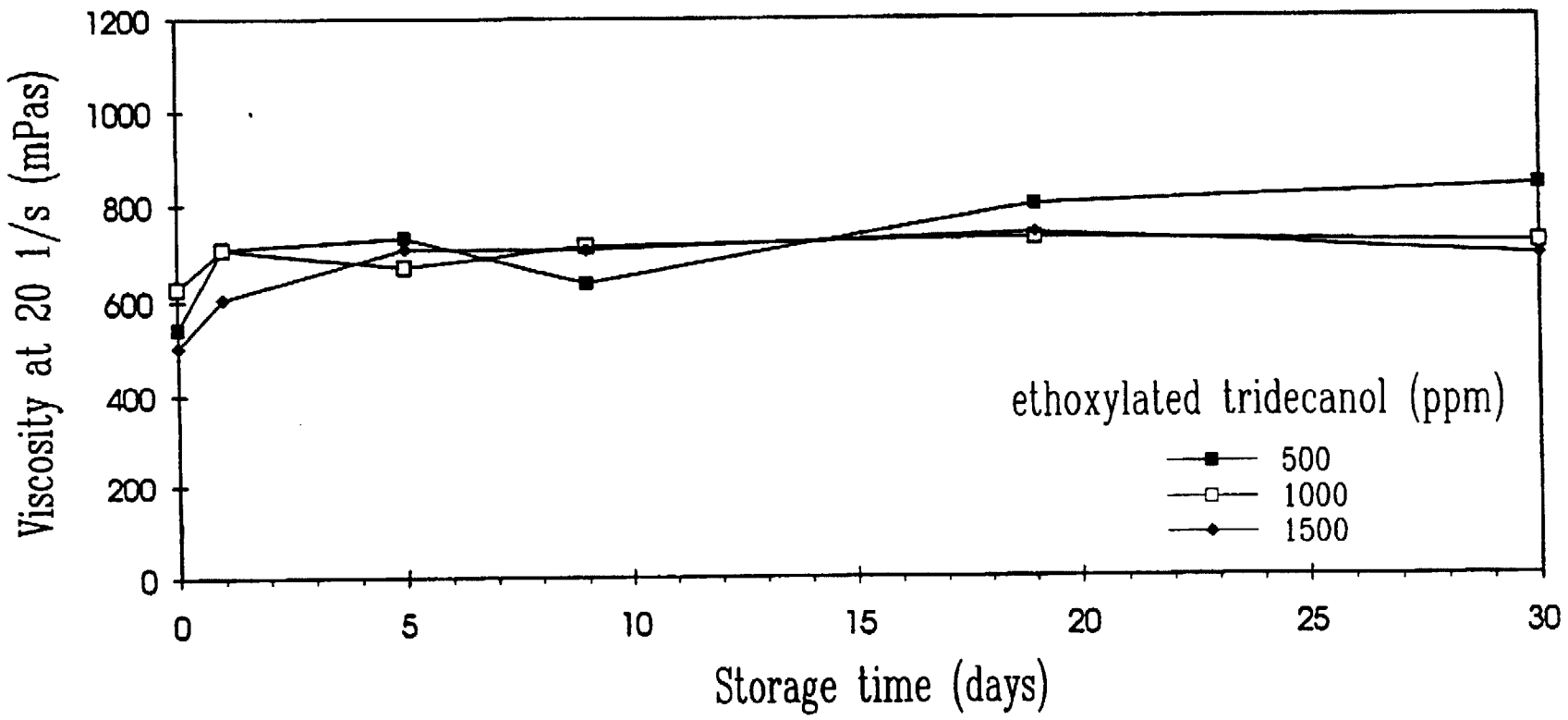
FIG. 15 illustrates viscosity over time for emulsions having 800 ppm monoethanolamine, 20 ppm sodium ions and different concentrations of ethoxylated tridecanol over storage at 25° C.
Figure 16:
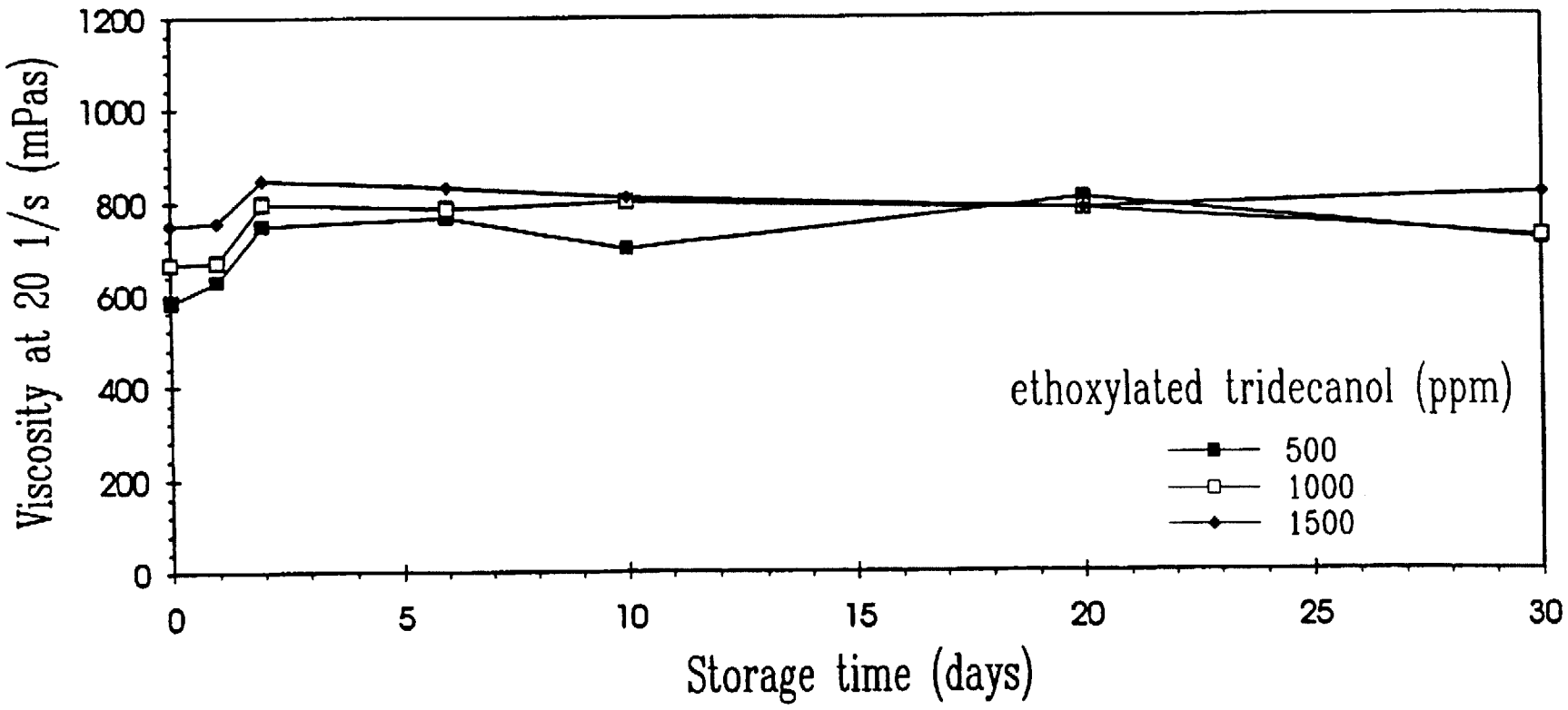
FIG. 16 shows the relation between viscosity and time for emulsions having 800 ppm monoethanolamine, 20 ppm sodium ions and different concentrations of ethoxylated tridecanol over storage at 45° C.

Finally, the viscosity of emulsions formed in accordance with the present invention having 800 ppm monoethanolamine and 20 ppm sodium ions in the formation water and different concentrations of ethoxylated tridecanol is shown in FIGS. 15 and 16 as a function of storage time for emulsions formed respectively at 25° C. and 45° C. FIGS. 15 and 16 show that the viscosity of emulsions formed in accordance with the present invention and using the surfactant additive of the present invention increase slightly during the initial day, and then stabilize to a practically constant value from the second storage day on. The initial increase in viscosity may be attributed to natural tendency to flocculate displayed by the dispersed system, with the resulting substantially constant viscosity being an indicator of a stable emulsion.

EXAMPLE 5

This example illustrates the stability of emulsions according to the present invention with emulsion water having electrolyte levels greater than 10 ppm and up to about 100 ppm.

Emulsions were prepared according to the invention using emulsion water having electrolyte levels of 20 ppm, 40 ppm and 60 ppm of $Mg^{++}$. The emulsions were formed according to the process of the present invention using 800 ppm of monoethanolamine and 1000 ppm of ethoxylated tridecanol. The emulsions so formed were then tested over storage time at storage temperatures of 30° C. and 45° C. for static stability. The results of this testing are set forth below in Table 5.

TABLE 5

| Storage Time | Storage Temp. = 30° C. | | Storage Temp. = 45° C. | |
|---|---|---|---|---|
| (days) | Dg (μm) | Visc. 1/s (mPas) | Dg (μm) | Visc. 1/s (mPas) |
| | | 20 ppm Mg++ | | |
| 0 | 12.81 | 675 | 12.81 | 675 |
| 1 | 12.81 | 483 | 13.11 | 555 |
| 2 | 13.53 | 591 | 13.37 | 518 |
| 5 | 13.7 | 631 | 13.58 | 692 |
| 12 | 13.75 | 620 | 14.2 | 542 |
| 14 | 13.28 | 614 | 14.23 | 508 |
| 21 | 13.77 | 694 | 13.60 | 593 |
| 30 | 13.64 | 483 | 14.42 | 629 |
| | | 40 ppm Mg++ | | |
| 0 | 13.23 | 513 | 13.23 | 513 |
| 1 | 14 | 462 | 13.63 | 395 |
| 2 | 12.67 | 374 | 13.35 | 425 |
| 3 | 13.63 | 429 | 12.96 | 489 |
| 6 | 13.43 | 548 | 13.03 | 483 |
| 13 | 13.97 | 420 | 12.84 | 387 |
| 15 | 14.09 | 454 | 14.59 | 420 |
| 21 | 14.75 | 503 | 14.28 | 516 |
| 30 | 14.6 | 501 | 14.32 | 424 |
| | | 60 ppm Mg++ | | |
| 0 | 16.22 | 478 | 16.22 | 478 |
| 1 | 16.59 | 452 | 16.36 | 314 |
| 2 | 16.7 | 439 | 16.45 | 426 |

TABLE 5-continued

| Storage Time | Storage Temp. = 30° C. | | Storage Temp. = 45° C. | |
|---|---|---|---|---|
| (days) | Dg (μm) | Visc. 1/s (mPas) | Dg (μm) | Visc. 1/s (mPas) |
| 3 | 16.68 | 405 | 16.88 | 336 |
| 7 | 15.86 | 410 | 16.32 | 433 |
| 10 | 16.29 | 369 | 17.35 | 370 |
| 15 | 16.8 | 420 | 17.00 | 393 |
| 21 | 16.83 | 412 | 17.21 | 284 |
| 30 | 16.71 | 484 | 17.13 | 349 |

As shown in Table 5 above, emulsions formed according invention using dilution water having electrolyte of 20, 40 and 60 ppm $Mg^{++}$ exhibit excellent static stability as shown by substantially constant droplet diameter and viscosity over time at both 30° C. and 45° C.

Emulsions were also prepared according to the invention using emulsion water with various levels of electrolyte, and these emulsions were tested for dynamic stability.

A number of emulsions were prepared according to the invention using 800 ppm monoethanolamine and 1000 ppm ethokylated tridecanol, and using dilution water having electrolyte levels of 10, 20, 30, 40, 50, 60, 70, 80, 90, and 100 ppm of $Mg^{++}$. The emulsions were tested for dynamic stability following the procedure of Example 3 set forth above Table 6 sets forth the results of this testing.

TABLE 6

AVERAGE DROPLET DIAMETER

| | Dg (μm) | | | | | | | | | |
|---|---|---|---|---|---|---|---|---|---|---|
| Shearing Time (min) | 10 ppm Mg++ | 20 ppm Mg++ | 30 ppm Mg++ | 40 ppm Mg++ | 50 ppm Mg++ | 60 ppm Mg++ | 70 ppm Mg++ | 80 ppm Mg++ | 90 ppm Mg++ | 100 ppm Mg++ |
| 0 | 17.88 | 15.56 | 14.85 | 15.25 | 16.04 | 17.05 | 16.41 | 17.66 | 20.72 | 18.83 |
| 5 | 18.34 | 15.79 | 15.88 | 15.95 | 16.76 | 17.99 | 17.41 | 17.88 | 19.61 | 19.1 |
| 10 | 18.49 | 16.21 | 15.98 | 16.85 | 16.8 | 18.19 | 18.33 | 18.36 | 18.62 | 20.94 |
| 15 | 17.27 | 16 | 16.66 | 16.48 | 16.86 | 18.37 | 17.1 | 19.59 | 20.83 | 20.97 |
| 20 | 18.35 | 16.48 | 16.94 | 16.97 | 17 | 17.56 | 17.54 | 19.47 | 22.05 | 22.49 |
| 30 | 18.45 | 17.21 | 16.76 | 16.84 | 17.55 | 19.2 | 16.36 | 20.89 | 20.68 | 25.22 |
| 40 | 19.62 | 17.13 | 17.12 | 17.54 | 17.51 | 20.2 | 18.85 | 23.21 | 21.65 | 28.59 |
| 50 | 19.91 | 18.5 | 17.71 | 18.65 | 18.16 | 21.85 | 21.55 | 24.98 | 23.25 | 33.02 |
| 60 | 20.27 | 17.88 | 17.76 | 19.5 | 18.44 | 19.3 | 22.39 | 27.18 | 25.43 | 37.42 |
| Visc. Initial 20 1/s mPas | 523 | 645 | 690 | 392 | 364 | 456 | 363 | 333 | 324 | 345 |
| Visc. Final 20 1/s mPas | 583 | 660 | 618 | 540 | 552 | 579 | 509 | 562 | 594 | |

As set forth above in Table 6, emulsions prepared according to the invention using monoethanolamine and ethoxylated tricadenol show excellent stability for emulsions formed using dilution water having electrolyte content exceeding 10 ppm $Mg^{++}$ and up to 100 ppm $Mg^{++}$.

This is in contrast to emulsions formed using only monoethanolamine which emulsions are not stable when formed with emulsion water having electrolyte content of even 10 ppm $Mg^{++}$.

Thus, this example clearly demonstrates the advantageous nature of the process and surfactant additive of the present invention wherein dilution water can be used having a greater electrolyte level than normally would be acceptable. Obviously, this presents an economic advantage in that emulsions can be formed according to the present invention without the added expense of insuring a water supply having an electrolyte level of less than 10 ppm.

The above examples further illustrate that the emulsions, process and surfactant additive of the present invention provide a stable bitumen-in-water emulsion which has a very high stability and acceptable rheological properties and which is provided using a surfactant additive having advantageous economic and environmental characteristics. Further, the emulsions so formed are stable and substantially less sensitive to variations in pH, water salinity and/or electrolyte content than emulsions stabilized using only monoethanolamine and the natural surfactant of the bitumen.

In light of the foregoing, it is clear that an emulsion, a process for forming the emulsion and a surfactant additive have been provided in accordance with the invention which readily accomplish the aforesaid objects and advantages.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A stable hydrocarbon-in-water emulsion, comprising:

a hydrocarbon phase containing natural surfactant;

a water phase having an electrolyte content greater than about 10 ppm (wt) with respect to the water phase; and a surfactant additive comprising an amine and an ethoxylated alcohol in amounts effective to activate said natural surfactant and stabilize the emulsion.

2. An emulsion according to claim 1, wherein said amine is present in an amount greater than or equal to about 300 ppm (wt) and said ethoxylated alcohol is present in an amount greater than or equal to about 100 ppm (wt) with respect to said hydrocarbon phase.

3. An emulsion according to claim 1, wherein said amine is present in an amount between about 300 ppm (wt) to about 1500 ppm (wt) with respect to said hydrocarbon phase.

4. An emulsion according to claim 1, wherein said amine is present in an amount of about 800 ppm (wt) with respect to said hydrocarbon phase.

5. An emulsion according to claim 1, wherein said ethoxylated alcohol is present in an amount between about 100 ppm (wt) to about 3000 ppm (wt) with respect to said hydrocarbon phase.

6. An emulsion according to claim 1, wherein said ethoxylated alcohol is present in an amount between about 500 ppm (wt) to about 1500 ppm (wt) with respect to said hydrocarbon phase.

7. An emulsion according to claim 1, wherein said amine is selected from the group consisting of monoethanolamine, ethylenediamine, ethylamine, diethylamine, triethylamine, propylamine, sec-propylamine, dipropylamine, isopropylamine, butylamine, sec-butylamine, tetramethylammonium hydroxide, tetrapropylammonium hydroxide and mixtures thereof.

8. An emulsion according to claim 1, wherein said amine is an ethanolamine.

9. An emulsion according to claim 1, wherein said amine is monoethanolamine.

10. An emulsion according to claim 1, wherein said ethoxylated alcohol is selected from the group consisting of polyethoxylated C12–C14, saturated polyethoxylated Cb 16–C18, unsaturated polyethoxylated C16–C18 and mixtures thereof.

11. An emulsion according to claim 10, wherein said ethoxylated alcohol is polyethoxylated tridecanol (C13).

12. An emulsion according to claim 1, wherein said hydrocarbon phase is bitumen.

13. An emulsion according to claim 1, wherein said hydrocarbon phase is Cerro Negro bitumen.

14. An emulsion according to claim 1, wherein said final hydrocarbon phase and said water phase are present at a ratio by volume of said hydrocarbon phase to said water phase of between about 90:10 to about 70:30. .

15. An emulsion according to claim 1, wherein said emulsion has a mean droplet size of less than or equal to about 30 microns.

16. A method for forming a stable hydrocarbon-in-water emulsion, comprising the steps of:

providing a hydrocarbon phase containing natural surfactant;

providing a water phase having an electrolyte content greater than about 10 ppm (wt) with respect to said water phase;

mixing said hydrocarbon phase and said water phase with a surfactant additive comprising an amine and an ethoxylated alcohol in amounts effective to activate said natural surfactant and stabilize the emulsion.

17. A method according to claim 16, wherein said amine is present in an amount greater than or equal to about 300 ppm (wt) and said ethoxylated alcohol is present in an amount greater than or equal to about 100 ppm (wt) with respect to said hydrocarbon phase.

18. A method according to claim 16, wherein said amine is present in an amount between about 300 ppm (wt) to about 1500 ppm (wt) with respect to said hydrocarbon phase.

19. A method according to claim 16, wherein said amine is present in an amount of about 800 ppm (wt) with respect to said hydrocarbon phase.

20. A method according to claim 16, wherein said ethoxylated alcohol is present in an amount between about 100 ppm (wt) to about 3000 ppm (wt) with respect to said hydrocarbon phase.

21. A method according to claim 16, wherein said ethoxylated alcohol is present in an amount between about 500 ppm (wt) to about 1500 ppm (wt) with respect to said hydrocarbon phase.

22. A method according to claim 16, wherein said amine is selected from the group consisting of monoethanolamine, ethylenediamine, ethylamine, diethylamine, triethylamine, propylamine, sec-propylamine, dipropylamine, isopropylamine, butylamine, sec-butylamine, tetramethylammonium hydroxide, tetrapropylammonium hydroxide and mixtures thereof.

23. A method according to claim 16, wherein said amine is an ethanolamine.

24. A method according to claim 16, wherein said amine is monoethanolamine.

25. A method according to claim 16, wherein said ethoxylated alcohol is selected from the group consisting of polyethoxylated C12–C14, saturated polyethoxylated C16–C18, unsaturated polyethoxylated C16–C18 and mixtures thereof.

26. A method according to claim 16, wherein said ethoxylated alcohol is polyethoxylated tridecanol (C13).

27. A method according to claim 16, wherein said hydrocarbon phase is bitumen.

28. A method according to claim 16, wherein said hydrocarbon phase is Cerro Negro bitumen.

29. A method according to claim 16, wherein said hydrocarbon phase and said water phase are present at a ratio by volume of said hydrocarbon phase to said water phase of between about 90:10 to about 70:30.

30. A method according to claim 16, wherein said mixing step comprises mixing said hydrocarbon phase with a portion of said water phase having an initial electrolyte content less than or equal to about 10 ppm (wt) and said surfactant additive so as to activate said natural surfactant and form an intermediate emulsion, and subsequently diluting said intermediate emulsion with a remainder of said water having a secondary electrolyte content greater than about 10 ppm (wt) and less than or equal to about 100 ppm (wt) so as to dilute said intermediate emulsion and provide a final hydrocarbon-in-water emulsion.

31. A method according to claim 30, wherein said intermediate emulsion has a ratio of hydrocarbon phase to water phase by volume of about 85:15, and said hydrocarbon-in-water emulsion has a ratio of hydrocarbon phase to water phase of about 70:30.

32. A method according to claim 16, wherein said mixing step provides a final hydrocarbon-in-water emulsion having a mean droplet size of less than or equal to about 30 microns.

* * * * *

UNITED STATES PATENT AND TRADEMARK OFFICE

CERTIFICATE OF CORRECTION

PATENT NO. : 5,792,223

DATED : August 11, 1998

INVENTOR(S) : Hercilio Rivas et al.

It is certified that error appears in the above-identified patent and that said Letters Patent is hereby corrected as shown below:

In column 13, claim 10, line 18, after "polyethoxylated" (second occurrence) delete "Cb" and insert --C--.

Signed and Sealed this

Fifteenth Day of June, 1999

*Attest:*

Q. TODD DICKINSON

*Attesting Officer*

*Acting Commissioner of Patents and Trademarks*